United States Patent [19]

Ohno

[11] 4,225,546

[45] Sep. 30, 1980

[54] METHOD OF COMPACTING DRY POWDER INTO SHAPES

[75] Inventor: John M. Ohno, Plymouth, Mich.

[73] Assignee: General Electric Company, Detroit, Mich.

[21] Appl. No.: 815,873

[22] Filed: Jul. 14, 1977

Related U.S. Application Data

[63] Continuation of Ser. No. 713,569, Aug. 11, 1976, abandoned, which is a continuation of Ser. No. 337,581, Mar. 2, 1973.

[51] Int. Cl.[2] ..... C22B 1/16

[52] U.S. Cl. ..... 264/114; 264/317

[58] Field of Search ..... 264/114, 317

[56] References Cited

U.S. PATENT DOCUMENTS

| | | | |
|---|---|---|---|
| 2,304,723 | 12/1942 | Wolff et al. | 264/114 |
| 2,435,227 | 2/1948 | Lester | 264/114 |
| 3,502,755 | 3/1970 | Murray | 264/317 |

*Primary Examiner*—Donald J. Arnold
*Assistant Examiner*—James R. Hall
*Attorney, Agent, or Firm*—Morgan, Finnegan, Pine, Foley & Lee

[57] ABSTRACT

A method of making shaped articles from powders comprises forming a cup mold of an organic polymeric material such as nylon, cellulose acetate, polymethylmethacrylate, polypropylene or polyethylene. The inner surface of the mold corresponds in configuration with the outer surface configuration desired in the shaped article. This mold is placed in a support member and filled with a measured quantity of powder. A plunger composed of a metal having a high specific gravity is placed on top of the powder, and the mold, mold support, powder and plunger combination is positioned in the swing bucket of a centrifugal apparatus where it is subjected to centrifugal force sufficient to achieve the desired degree of compaction of the powder. The mold is then removed and subjected to treatment at a temperature which is sufficient in the first instance to eliminate the polymeric mold material, as by melting or burning, and then sufficient to sinter the powder. If desired, the surface of the plunger making contact with the powder may be shaped so as to provide a pattern on the powder surface, or to impart a chamfered surface to the powder.

6 Claims, 2 Drawing Figures

FIG. 1
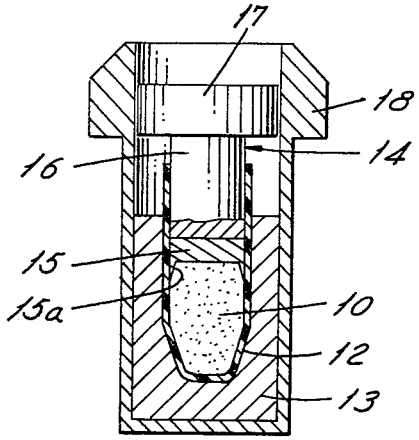
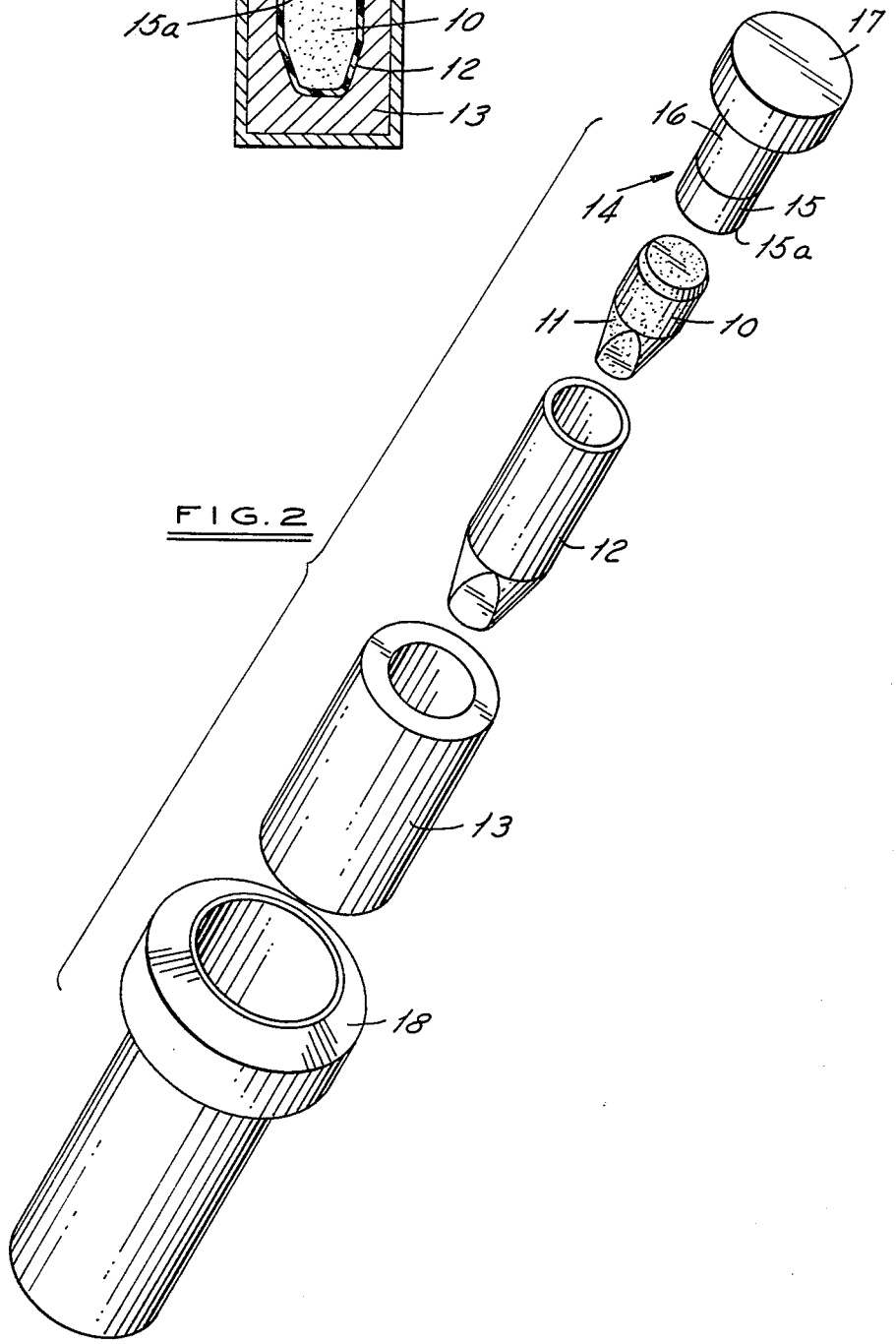
FIG. 2

METHOD OF COMPACTING DRY POWDER INTO SHAPES

This is a continuation, of application Ser. No. 713,569, filed Aug. 11, 1976, now abandoned which is a continuation of Ser. No. 337,581, Mar. 2, 1973.

BACKGROUND OF THE INVENTION

In forming small parts of metal powder it has been customary to mix the powder with a small quantity of binder material and compact it in a mold with sufficient pressure to enable the compacted material to hold its shape after withdrawal from the mold. The shaped material is then sintered in an oven to drive off the binder material and to impart cohesiveness to the shaped mass.

This method of forming is applied not only to powders composed entirely of metal particles but also to powders which are formed into refractory shapes referred to as cermets, such as cemented tungsten carbides.

While compaction of the powders is usually achieved in a press having reciprocating movement, it may also be achieved by the application of centrifugal force as illustrated in Wolff et al. U.S. Pat. No. 2,304,723. The present invention is directed toward a process for making shaped articles using centrifugal compaction. The use of centrifugal compaction in accordance with the present invention can provide finished articles having more uniform compaction than when pressed compaction is used. In addition, centrifugal compaction in accordance with this invention provides the designer with greater freedom in designing parts. For example, a tungsten carbide part for which there is considerable demand consists of a cylinder terminating at one end in a generally cone-shaped portion. This part can be made by press compaction only if the ratio of the cone height to the total height is less than 51% and the cone angle is greater than 19°. These limitations are not present if the present invention is used.

SUMMARY OF THE INVENTION

The present invention is directed particularly to the production of cemented metal carbide parts. In accomplishing the objects of the invention a cup mold of polymeric plastic material is filled with a measured quantity of a powder such as tungsten carbide or titanium carbide in which has been incorporated a powder of binder material such as cobalt or nickel. A plunger of heavy metal having a snug fit with the orifice of the cup mold is inserted in the mold which is then placed in a supported position within the swing bucket of a centrifugal machine. The machine is then operated to apply centrifugal force against the powder particles with the help of the heavy metal plunger. This imparts a uniform compaction to the powder particles. If desired, the portion of the plunger which engages the powder particles may have a configuration to impart a chamfer or pattern to the powder.

After compaction the mold is removed from the swing bucket, the plunger removed from the mold, and the mold with the compacted particles is subjected to the application of heat. Heat may be applied in a first stage to eliminate the mold as by melting or burning and a second stage at a higher temperature to effect the sintering of the particles into a cohesive mass.

DESCRIPTION OF THE DRAWING

FIG. 1 is a sectional view of a centrifugal swing bucket in which there is positioned a mold, mold support, powder charge, and plunger.

FIG. 2 is an exploded perspective view of the swing bucket, mold, mold support, and plunger shown in FIG. 1 and a view of a final sintered particle made by the process of this invention.

DESCRIPTION OF PREFERRED EMBODIMENT

A dome compact as illustrated in powder form 10 in FIG. 1 and in sintered form 11 in FIG. 2 is typical of products that may be made in accordance with this invention. A typical dome compact is about 2 centimeters long by 1½ centimeters in diameter. In producing such an article a polymeric plastic mold 12 in which the inside surface conforms to the desired outside surface of the finished article is prepared. The mold 12 is roughly in the shape of a cup having an orifice which leads to a passageway of substantially uniform cross-sectional area. The mold 12 is generally formed of a thermoplastic such as nylon, cellulose acetate, polymethylmethacrylate, polypropylene, and polyethylene. The best polymer is one which may be easily formed into a mold shape, possesses lubricating qualities, can withstand pressure without changing shape, and can be totally separated from powder after compaction by the application of heat. It is obvious that many polymeric materials possess properties which would enable them to be used in the mold. However, of those specifically listed above polyethylene is considered the best followed rather closely by polypropylene.

In use the mold 12 is filled with a weighed quantity of powder particles 10. The particles 10 may be of any material which is to be subjected to a subsequent sintering step. Metal carbide compact may be formed from metal carbide powder to which has been added the powder of cobalt or a similar cementing metal.

The cup mold 12 with its powder charge 10 is placed in a support 13 formed of a material such as aluminum alloy. A plunger 14 having a punch face 15 composed of a material such as tungsten carbide, a shank portion 16 composed of a metal of high specific gravity and a guide portion 17 also composed of a metal of high specific gravity is inserted through the orifice of the mold 12. It is extremely important that the punch portion 15 of the plunger 14 has a snug fit in the mold 12; and a guide portion 17 has a snug fit in the swing bucket 18. It is also desirable that the punch face 15 have its outer edge formed with a circular embossment **15*a* which will imprint a chamfer in the surface of the powder 10** with which it makes contact.

The assembly consisting of the powder 10, mold 12, mold support 13, and plunger 14 is positioned in a centrifugal swing bucket 18. The bucket 18 is then mounted in a centrifuge which is a standard piece of equipment available on the market and, therefore, will not be described herein. Typical treatment in a centrifuge in which the radius is 10 to 13 centimeters is 9000 rpm for approximately one minute, or five minutes from on to off with the switch operated automatically. This produces uniform compaction of the powder 10. Upon removal of the bucket 18 from the centrifuge there is no tendency for the compacted powder to spring back as seen in the conventional press compaction.

After compaction of the powder 10 into the dome compact illustrated at 11 in FIG. 2, the mold 12 with its compacted powder is removed from the support member 13 and the plunger 14 is withdrawn. The mold is first subjected to a pre-sintering step at an elevated temperature of about 500°–600° C. This temperature is sufficient to vaporize the mold material and the finished article 11 is then ready for the sintering step. The sintering step is carried out at an elevated temperature. In the case of tungsten carbides this temperature is about 1450°–1500° C. This temperature varies depending on the cementing material and alloy composition. After densification has been achieved the finished article is slowly cooled to room temperature.

While the invention has been described with reference to centrifugal compaction, there are times when a combination of conventional pressing followed by centrifugal compaction will produce an improved product. For instance, it is difficult to crush hard granules at the nose of the powder 10 (FIG. 1) using centrifugal compaction only. However, these hard granules may be crushed by frictional force in a conventional press operation. The charge may then be subjected to centrifugal compaction to produce an improved final product.

The effect of the various processing steps on the powder 10 will be appreciated from the following dimensions of the dome compact 11 after successive treatments:

Height as loaded: 3.88 centimeters
Height as hand pressed: 2.72 centimeters
Height after centrifugal compaction: 2.41 centimeters
Height after presintering at 550° C.: 2.39 centimeters
Height after sintering at 1450° C.: 1.94 centimeters In all cases the density of the final product was the same as, or greater than, the density of the same product made by compaction in a press. However, centrifugal compaction provides substantially the same pressure to all parts of the powder whereas the conventional press produces a range of pressures throughout the powder.

The ability of the plunger 14 to apply not only compaction pressure but also a chamfered or other surface to the dome 11 is wholly unexpected. Such a chamfered surface cannot be produced by a conventional press process. In a conventional press process it is necessary to employ a soft-forming operation to form a chamfer. Thus, the centrifugal compaction process as practiced in the present invention eliminates the soft forming operation at the cone as well as the base chamfer.

While the invention has been described with reference to certain specific embodiments it is obvious that there may be variations which properly fall within the scope of the invention. Accordingly, the invention should be limited in scope only as may be necessitated by the scope of the appended claims.

What I claim as new and desire to secure by letters patent of the United States is:

1. A method of making shaped articles from sinterable powder which comprises (a) introducing said powder into a cup mold composed of organic polymeric material selected from the group consisting of nylon, cellulose, acetate, polymethylmethacrylate, polypropylene, and polyethylene, with an inner surface configuration corresponding to the outer surface configuration desired in the shaped article, said cup mold being supported by a metal mold support, (b) positioning a metallic plunger, having a shank contoured to have a snug fit in said mold, so as to make contact with the powder, (c) subjecting the powder mold, mold support, and plunger to centrifugal force to compress the powder against the inner wall of said mold, (d) removing said polymeric mold with shaped compressed powder from said mold support, (e) heating said mold and compressed powder to vaporize said mold and (f) further heating to sinter said shaped compressed powder.

2. The method of claim 1 wherein the organic polymeric material is polyethylene.

3. The method of claim 1 wherein the plunger has an enlarged head portion.

4. The method of claim 3 wherein the plunger has a face composed of cemented tungsten carbide.

5. The method of claim 4 wherein the face of the plunger is contoured to mold the surface of the powder with which it makes contact.

6. The method of claim 5 wherein the face of the plunger is contoured to chamfer the powder article.

* * * * *